US008056988B2

(12) United States Patent
Pan

(10) Patent No.: US 8,056,988 B2
(45) Date of Patent: Nov. 15, 2011

(54) CABINET ASSEMBLY

(76) Inventor: Hui-Lan Pan, Taipei (TW)

( * ) Notice: Subject to any disclaimer, the term of this patent is extended or adjusted under 35 U.S.C. 154(b) by 577 days.

(21) Appl. No.: 12/008,880

(22) Filed: Jan. 15, 2008

(65) Prior Publication Data

US 2009/0179532 A1 Jul. 16, 2009

(51) Int. Cl.
*A47B 95/00* (2006.01)

(52) U.S. Cl. ..... 312/201; 312/351; 312/334.27; 312/287

(58) Field of Classification Search ..... 312/201, 312/351, 334.27, 334.29, 334.34, 287, 249.9; 108/107, 109
See application file for complete search history.

(56) References Cited

U.S. PATENT DOCUMENTS 2,967,625 A * 1/1961 Hoogenstyn ..... 211/183
4,084,125 A * 4/1978 King ..... 312/199
5,683,155 A * 11/1997 Sarno ..... 312/201
5,924,779 A * 7/1999 Krumholz ..... 312/198
6,027,190 A * 2/2000 Stewart et al. ..... 312/201
6,036,286 A * 3/2000 Krumholz ..... 312/198
6,231,138 B1 * 5/2001 Janson ..... 312/201
7,114,789 B2 * 10/2006 Keaton ..... 312/132
7,257,925 B2 * 8/2007 Manogue et al. ..... 52/29
2003/0094884 A1 * 5/2003 Sobol ..... 312/201

* cited by examiner

*Primary Examiner* — Janet M Wilkens
*Assistant Examiner* — Daniel Rohrhoff
(74) *Attorney, Agent, or Firm* — Charles E. Baxley

(57) ABSTRACT

A cabinet assembly has at least one cabinet. Each cabinet is a frame and has multiple erect bars, a front board, a rear board, a bottom board, a left opening, a right opening, a wheel assembly and an inner chamber. The wheel assembly is mounted on a lower surface of the bottom board and has multiple wheels and a substrate. The wheels are mounted on the lower surface of the bottom board. The substrate is mounted below the bottom board and contacts to the wheels, allows the wheels to slide on the substrate and holds the cabinet. The inner chamber is formed between the front board, the rear board and the bottom board and communicates with the left opening and the right opening. Therefore, users put the objects from both the left opening and the right opening, so the cabinet assembly is very convenient for the users.

3 Claims, 14 Drawing Sheets

CABINET ASSEMBLY

BACKGROUND OF THE INVENTION

1. Field of Invention

The present invention relates to a cabinet assembly, and more particularly to a cabinet assembly that is moveable, is convenient for users to take objects from or put the objects in the cabinet assembly and is able to be reused. The users can decide how many cabinets they want to use according to available space.

2. Description of the Related Art

With reference to FIG. 14, a conventional cabinet (30) has an open front, a rear and an inner space. The open front may comprise a door (32), a window or the like to close the open front. The inner space has a board (31). The board (31) allows users to put books or other objects on the board (31) in the inner space.

When the books (21) are put on the board (31) close to the rear, the board (31) near the open front still has almost a half space being available. Thus, the users can put another books (22) on the board (31) in the half space. However, the outer row of books (22) shelters the inner row of books (21), and the users cannot see titles of the books (21), so users are difficult to find a book they want. Moreover, when the users want to take the books (21) from the cabinet (30), they have to remove the outer row of books (22) and then take the books (21). Therefore, it is inconvenient for the users and is time-consuming.

Furthermore, if the books or objects are arranged disorderly in the conventional cabinet (30), the appearance of the cabinet (30) with the disorder books or objects is mess when the cabinet (30) does not have a door (32) or has a see-through window or door (32).

Additionally, if the users live in a city, they usually live in a limited space, such as an apartment or the like. Therefore, how to completely use the space and to make the space cozy without stress is important to the users. However, the conventional cabinet (30) has a fixed size, so the conventional cabinet (30) and cannot fit with spatial designs for different rooms or apartments. For example, a traditional wooden cabinet has an unchangeable size, so the traditional wooden cabinet and an available space cannot match exactly. Accordingly, a specific cabinet will be produced for a specific available space, but the users have to spend much time, a lot of money for the specific cabinet. Moreover, the wooden cabinet is heavy and is hardly disassembled. Once the wooden cabinet is submerged in flood, it has to be thrown away, so it wastes wooden source.

To overcome the shortcomings, the present invention provides a cabinet assembly to mitigate or obviate the aforementioned.

SUMMARY OF THE INVENTION

The primary objective of the present invention is to provide a cabinet assembly that is moveable, is convenient for users to take objects from or put the objects in the cabinet assembly and is able to be reused.

To achieve the objective, a cabinet assembly in accordance with the present invention comprises at least one cabinet. Each cabinet is a frame and has multiple erect bars, a front board, a rear board, a bottom board, a left opening, a right opening, a wheel assembly and an inner chamber. The wheel assembly is mounted on a lower surface of the bottom board and has multiple wheels and a substrate. The wheels are mounted on the lower surface of the bottom board. The substrate is mounted below the bottom board and contacts the wheels, allows the wheels to slide on the substrate and holds the cabinet. The inner chamber is formed between the front board, the rear board and the bottom board and communicates with the left opening and the right opening. Therefore, users put the objects from both the left opening and the right opening, so the cabinet assembly is very convenient for the users.

Other objectives, advantages and novel features of the invention will become more apparent from the following detailed description when taken in conjunction with the accompanying drawings.

DETAILED DESCRIPTION OF THE INVENTION

Figure 1:
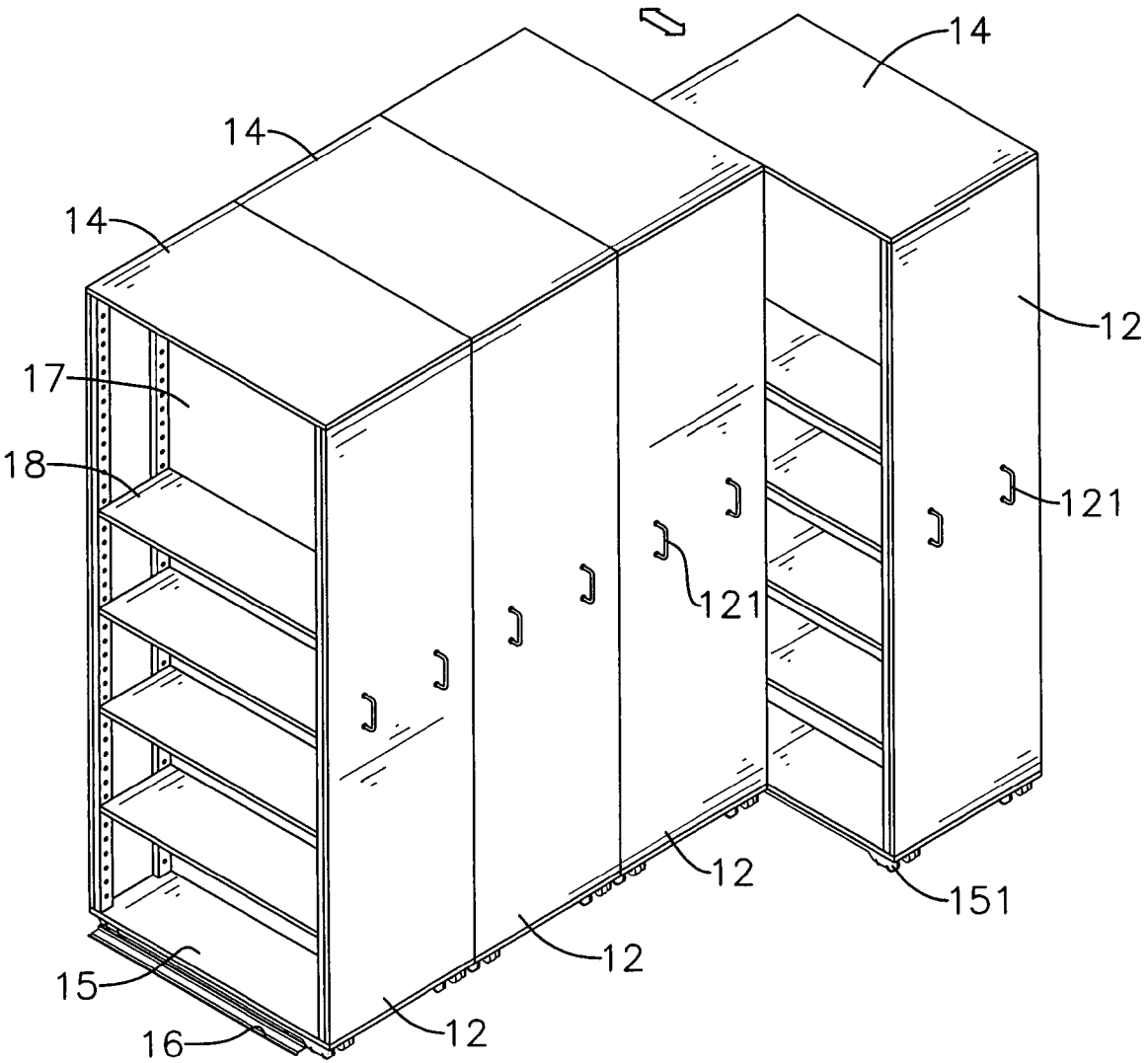
FIG. 1 is a perspective view of a cabinet assembly in accordance with the present invention.

With reference to FIG. 1, a cabinet assembly in accordance with the present invention can be assembled easily by users. The cabinet assembly has at least one cabinet.

Figure 2:
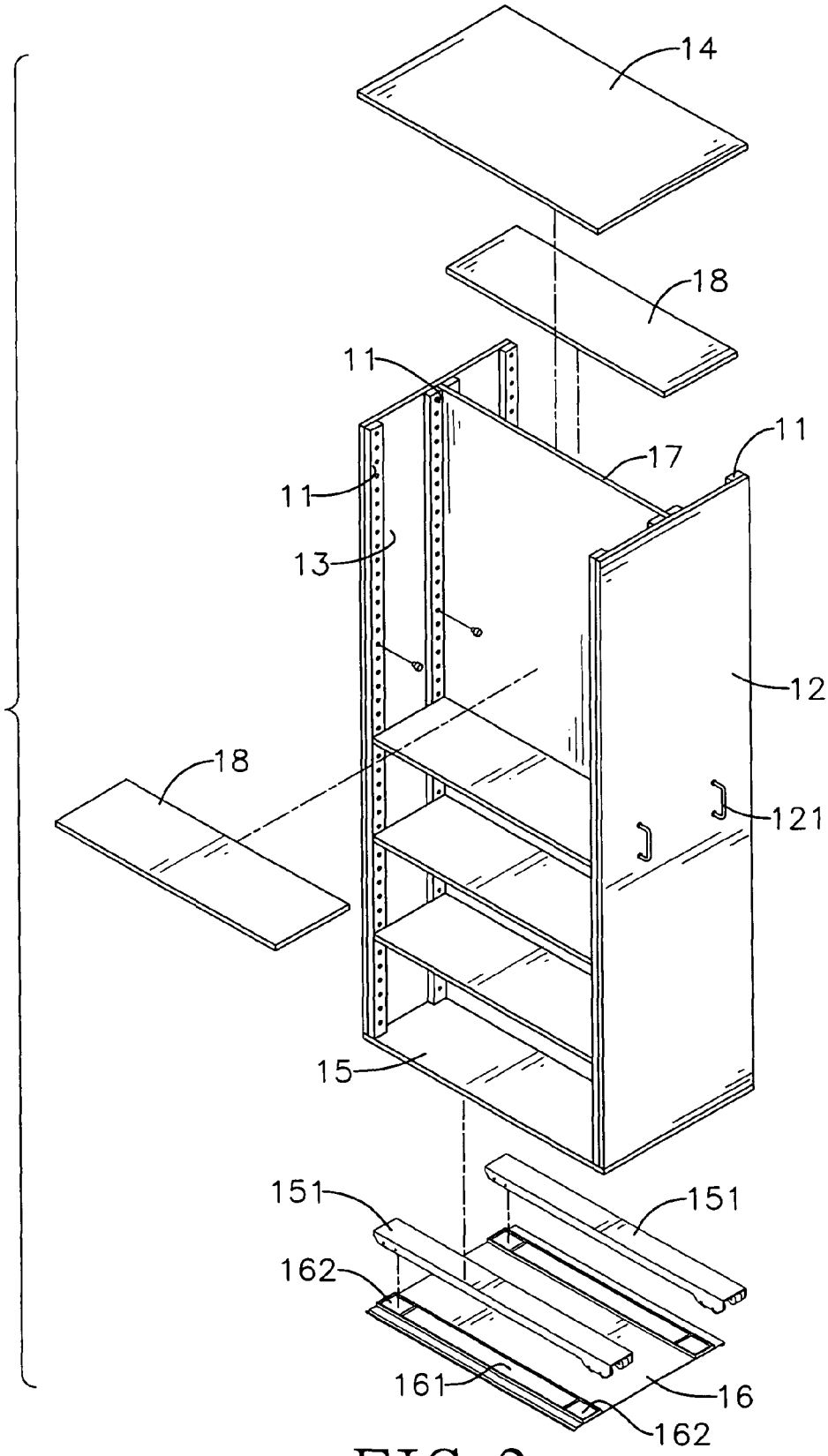
FIG. 2 is an exploded perspective view of a first embodiment of a cabinet of the cabinet assembly in FIG. 1.
Figure 3:
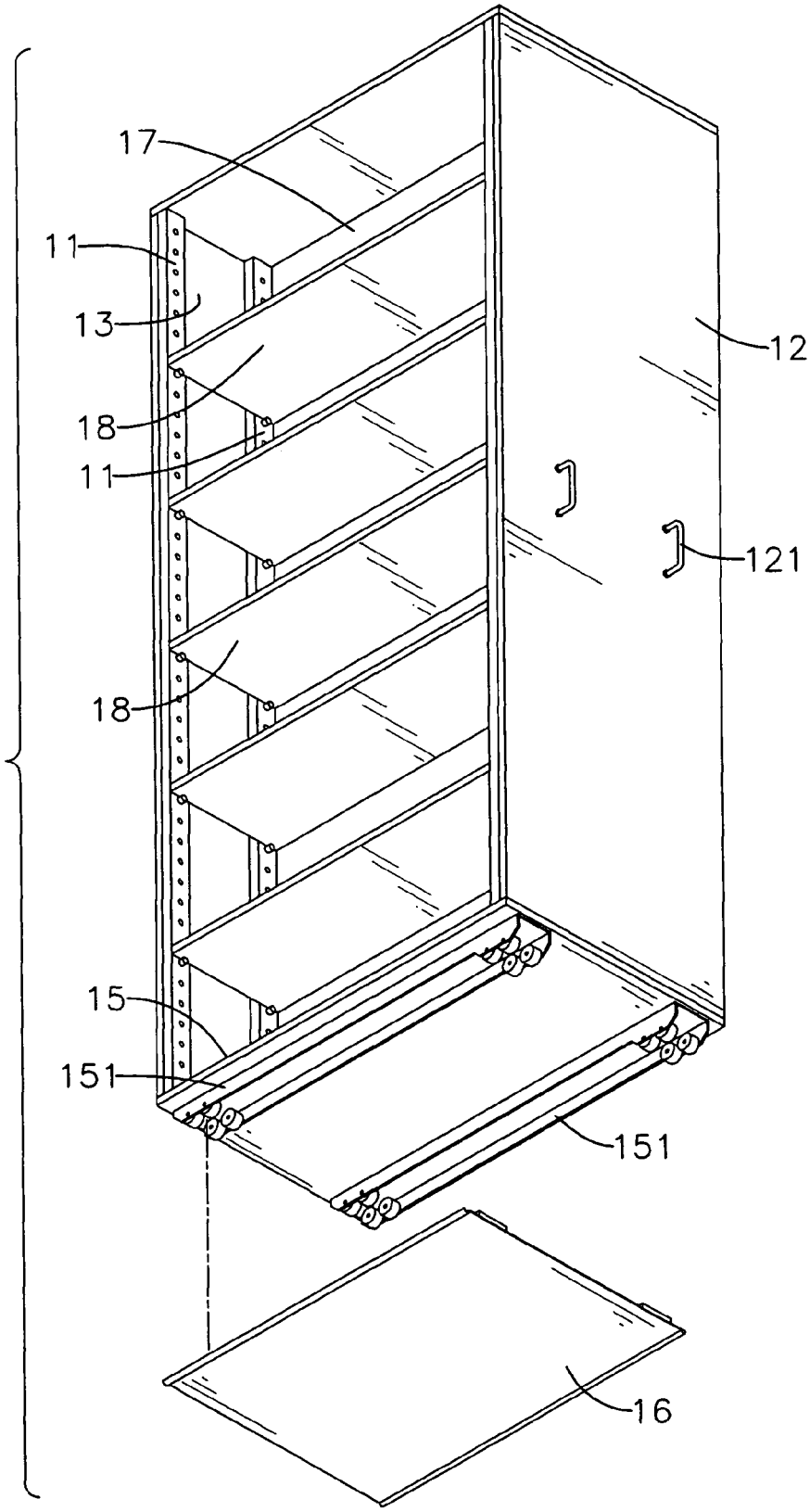
FIG. 3 is another exploded perspective view of the cabinet of the cabinet assembly in FIG. 2.

With further reference to FIGS. 2 and 3, each cabinet is a rectangular frame and may be a metal frame and preferably be an angle steel frame. The frame has multiple erect bars (11), a front board (12), a rear board (13), a top board (14), a bottom board (15), a left opening, a right opening, a wheel assembly (151) and an inner chamber.

Each erect bar (11) has multiple through holes.

The front board (12) has at least one handle (121) and preferably has two handles (121).

Each handle (121) is mounted on the front board and allows the users to hold and pull or push the cabinet.

Figure 8:
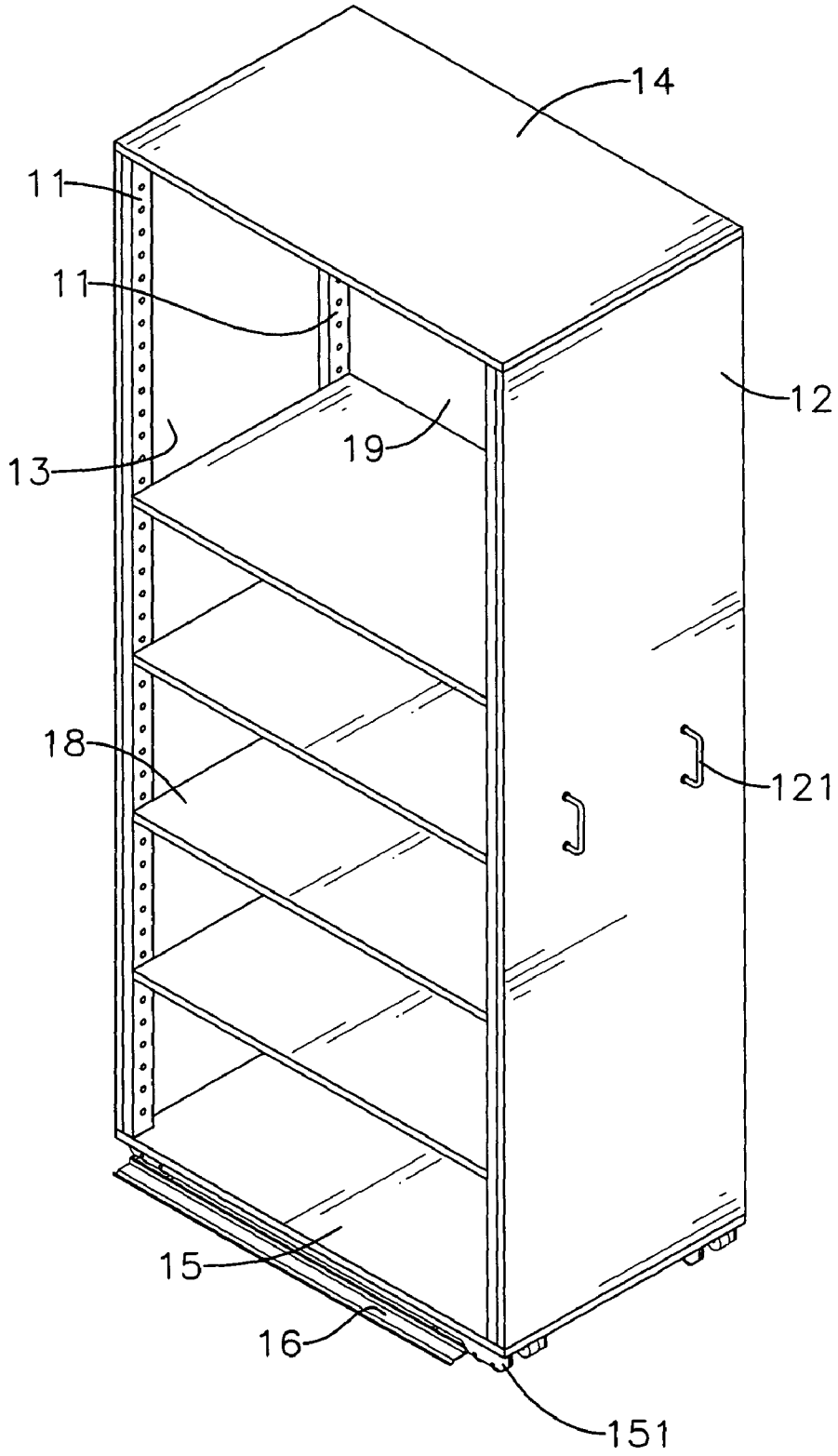
FIG. 8 is a perspective view of a second embodiment of a cabinet with a sideboard of a cabinet assembly in accordance with the present invention.

With further reference to FIG. 8, the left opening allows people to put objects such as books, clothes or the like in or take the objects from the cabinet. When the cabinet assembly of the present invention comprises more than two cabinets, the left opening of one of the cabinets abutting to a wall may have a sideboard (19). The sideboard (19) closes the left opening when the left opening faces a wall of a room to prevent the objects from dropping out of the cabinet from the left opening.

The right opening also allows people to put objects such as books, clothes or the like in or take the objects from the cabinet. When the cabinet assembly of the present invention comprises more than two cabinets, the right opening of one of the cabinets abutting to a wall may have a sideboard. The sideboard closes the right opening when the right opening faces a wall of a room to prevent the objects from dropping out of the cabinet from the right opening. When the right opening is closed by the sideboard, the left opening must be open. Alternatively, when the left opening is closed by the sideboard (19), the right opening must be open.

Figure 4:
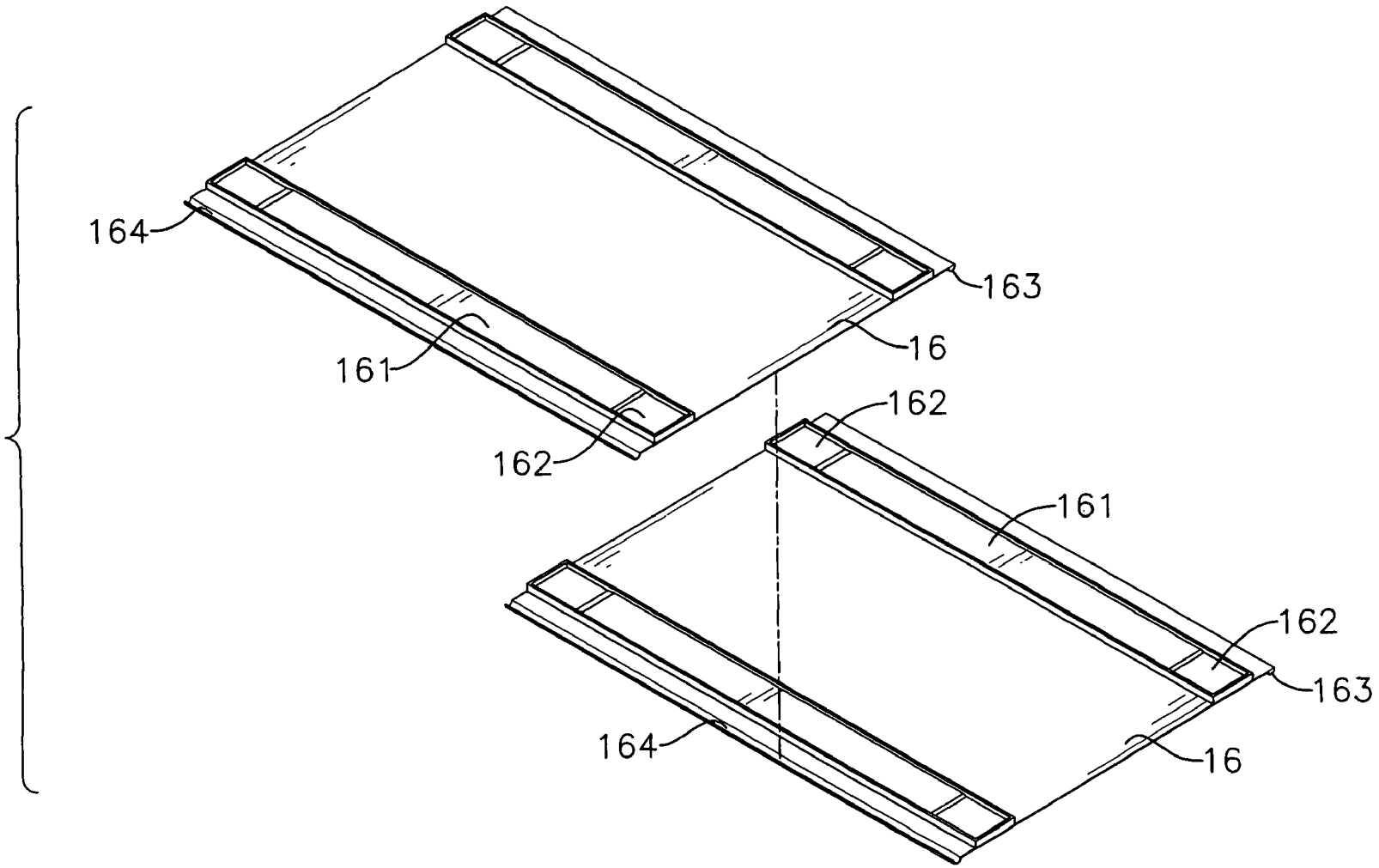
FIG. 4 is an exploded perspective view of two substrates of the cabinet assembly in FIG. 1.
Figure 5:
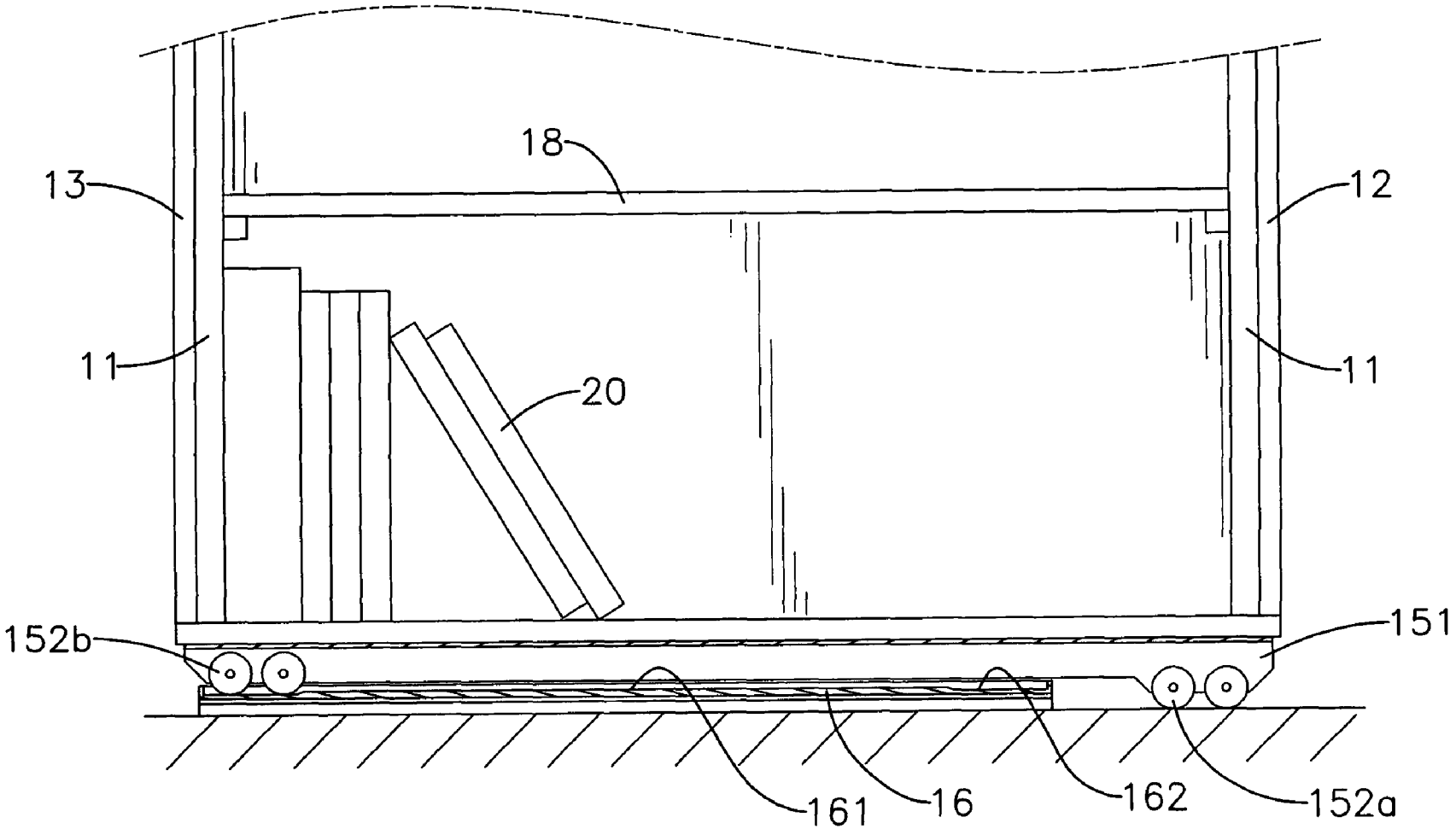
FIG. 5 is a partial side view of the cabinet of the cabinet assembly in FIG. 1 at an original position.

With further reference to FIGS. 4 and 5, the wheel assembly (151) is mounted on a lower surface of the bottom board (15) to make the cabinet slidable, so the users can move the cabinet easily. The wheel assembly (151) has two lines of wheels and has a substrate (16). The lines of the wheels are mounted longitudinally on the lower surface of the bottom board (15) in parallel and are respectively near the left opening and the right opening. Each line of the wheels comprises a first group of wheels (152*a*) and a second group of wheels (152*b*). The first group of wheels (152*a*) are mounted longitudinally on the lower surface of the bottom board (15) near the front board (12). The first group of wheels (152*a*) preferably comprises two wheels. The second groups of wheels (152*b*) are mounted longitudinally on the lower surface of the bottom board (15) near the rear board (13). The second group of wheels (152*b*) preferably comprises two wheels.

The substrate (16) is mounted below the bottom board (15) and contacts the lines of the wheels, allows the lines of the wheels to slide on the substrate (16) and holds the cabinet. The substrate (16) has an upper surface, a lower surface, a front, a rear, two sides, a first connector (163), a second connector (164) and two channels (161). The first connector (163) is formed on one of the sides of the substrate (16) and may be a recess or a protrusion. The second connector (164) corresponds to the first connector (163), is formed on the other side of the substrate (16) and may be a protrusion or a recess. The second connector (164) of one substrate (16) connects the first connector (163) of an adjacent substrate (16). The channels (161) are formed in the upper surface of the substrate (16), correspond respectively to the second groups of wheels (152*b*) and allow the second groups of wheels (152*b*) to slide along the channels (161). The second group of the wheels (152*b*) is located outside the channels (161) of the substrate (16) and is substantially flush with the lower surface of the substrate. Each channel (161) has two limiting protrusions (162). The limiting protrusions (162) respectively protrude in the channel (161) from the front and the rear of the substrate (16) and limit the second groups of wheels (152*b*) to slide only in the channel (161). Therefore, the wheel assembly allows the users to move the cabinet easily, so it is very convenient for the users.

Figure 6:
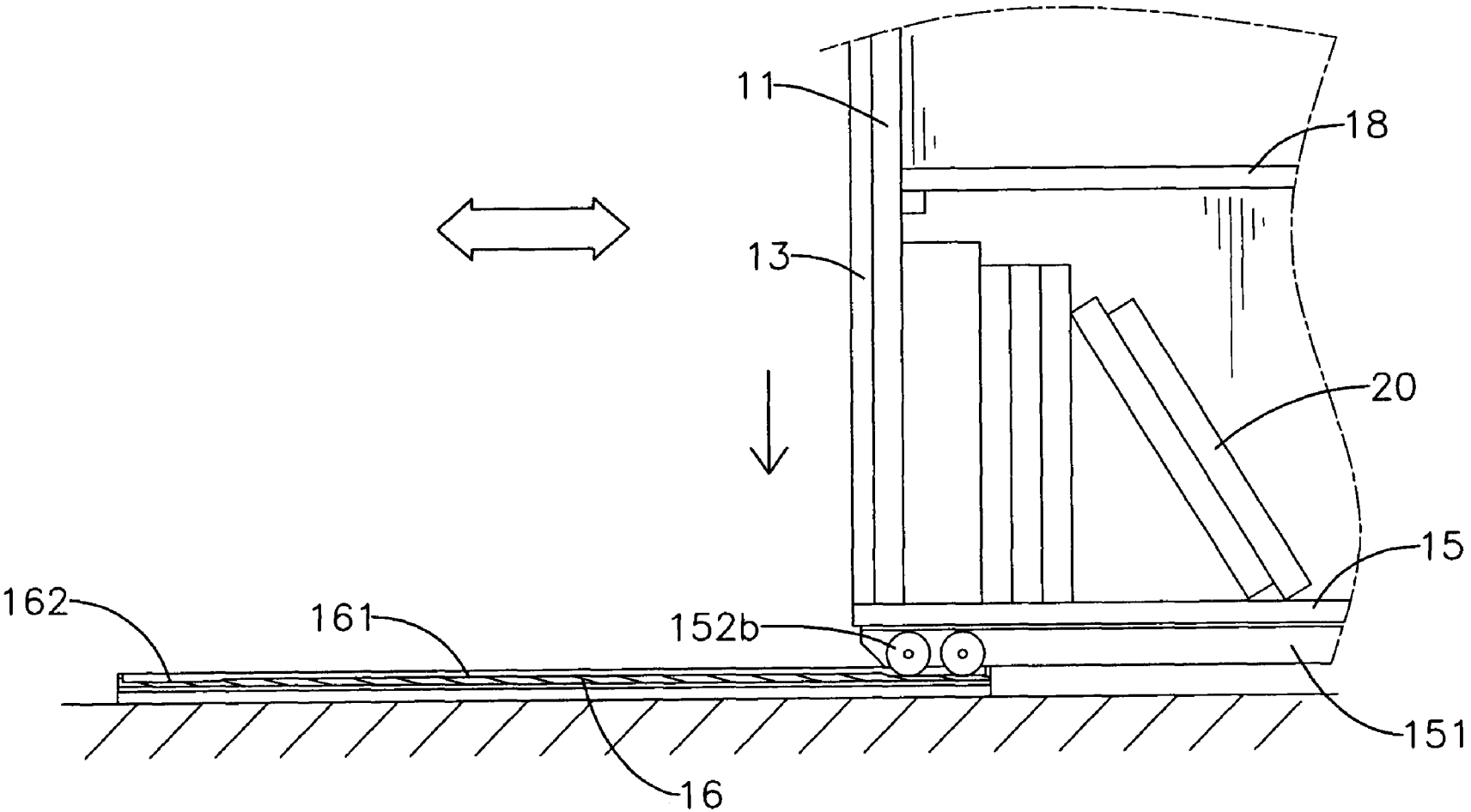
FIG. 6 is a partial side view of the cabinet of the cabinet assembly in FIG. 5 at a moving position.

With reference to FIGS. 5 and 6, when the cabinet is at an original position, the second groups of wheels (152*b*) abut the limiting protrusions (162) protruding from the rear of the substrate (16). When the cabinet is pulled forward, the second groups of wheels (152*b*) may abut the limiting protrusions (162) protruding from the front of the substrate (16) to position the second groups of the wheels (152*b*).

Figure 7:
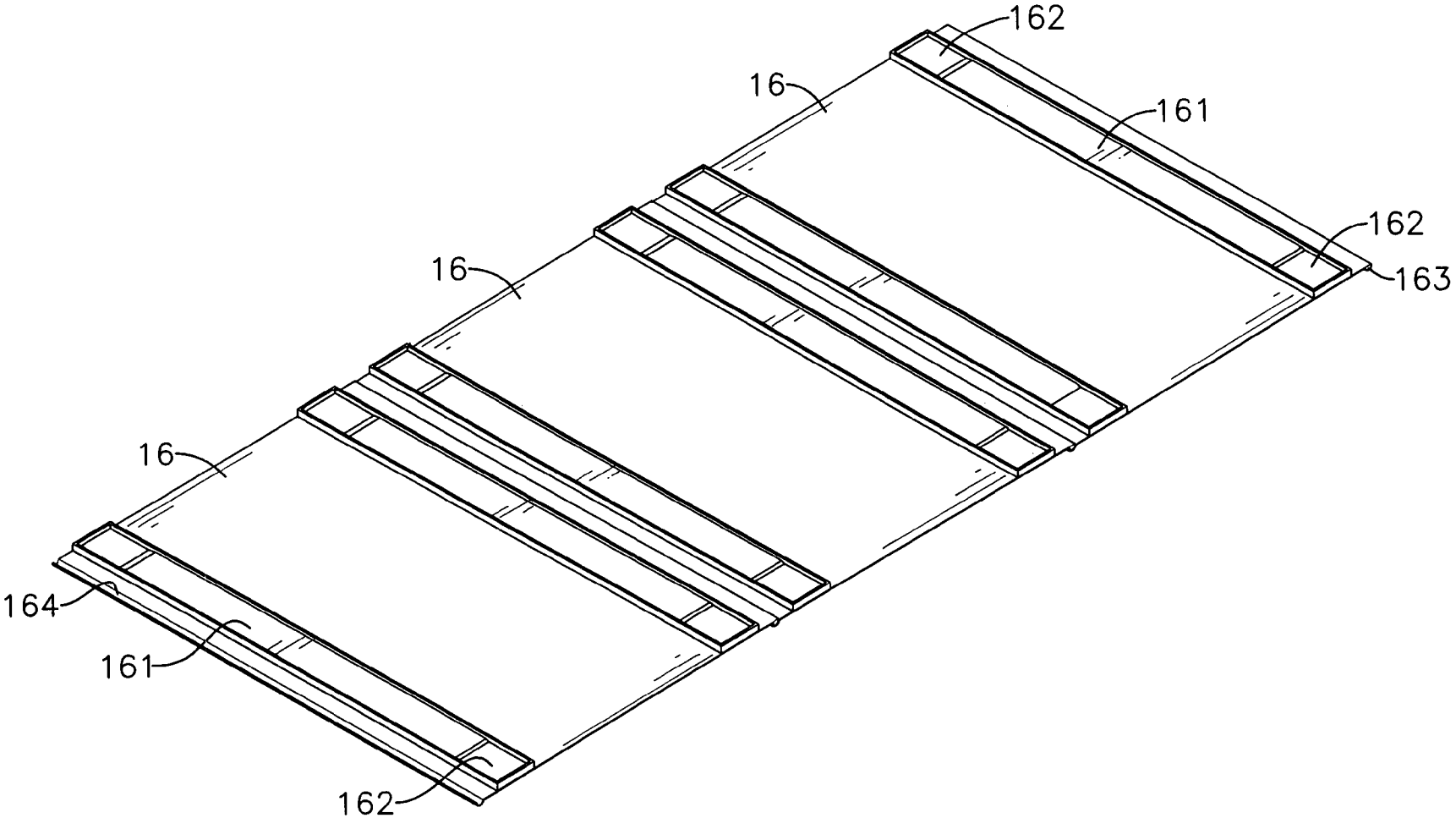
FIG. 7 is a perspective view of three substrates of the cabinet assembly in FIG. 1.

With reference to FIGS. 1 and 7, the present invention may comprise multiple cabinets. The cabinets are arranged side by side. Therefore, multiple substrates (16) are able to connect to each other by the first connector (163) and the second connector (164) and are mounted on the ground. Because weights of the cabinets respectively fall on corresponding substrates (16), when the users pull one of the cabinets, the substrates (16) will not be moved and the ground will not be damaged.

The inner chamber is formed between the front board (12), a rear board (13), a top board (14) and a bottom board (15) and communicates with the left opening and the right opening.

Figure 9:
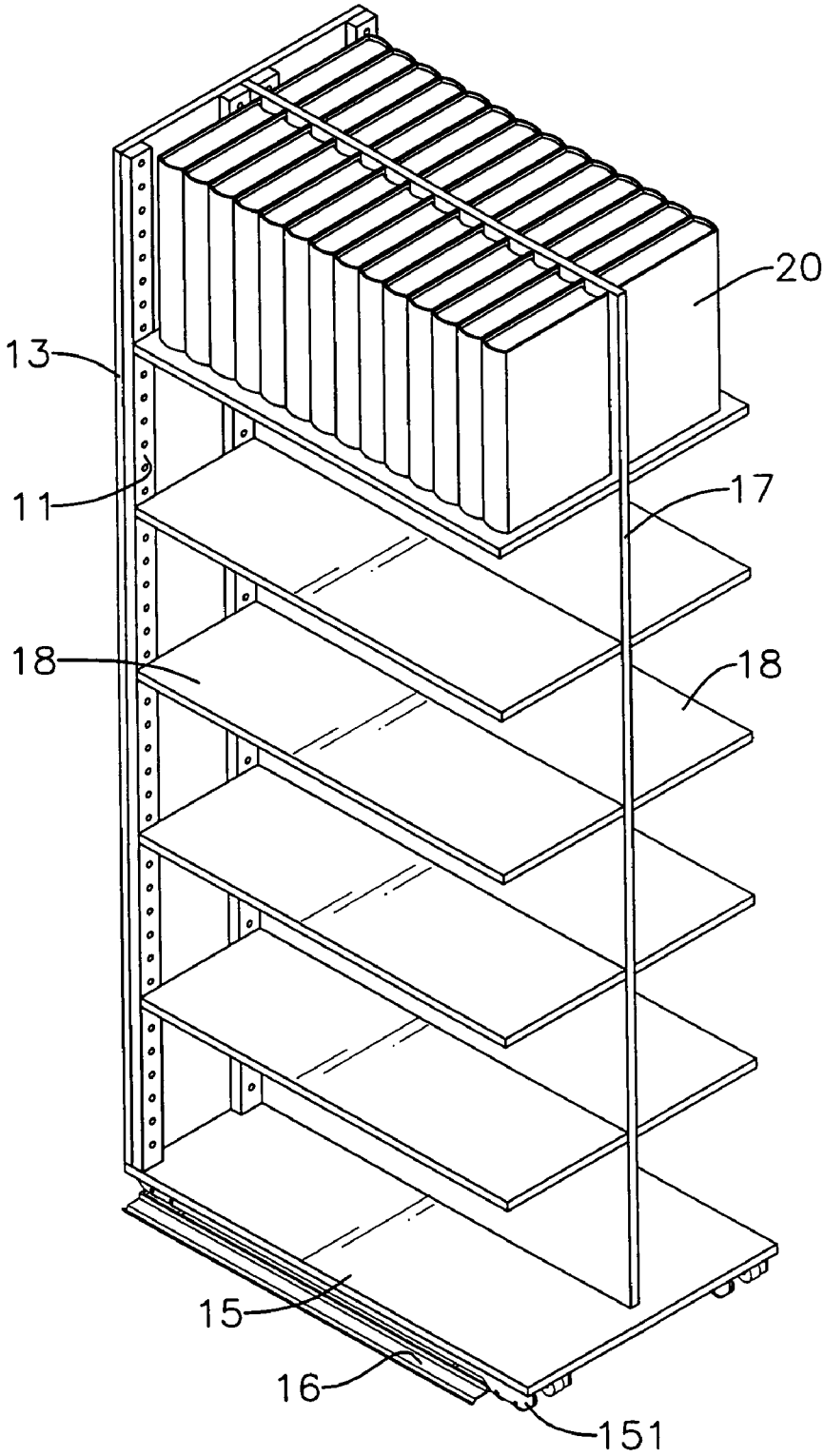
FIG. 9 is a perspective view of a third embodiment of a cabinet of a cabinet assembly in accordance with the present invention.
Figure 10:
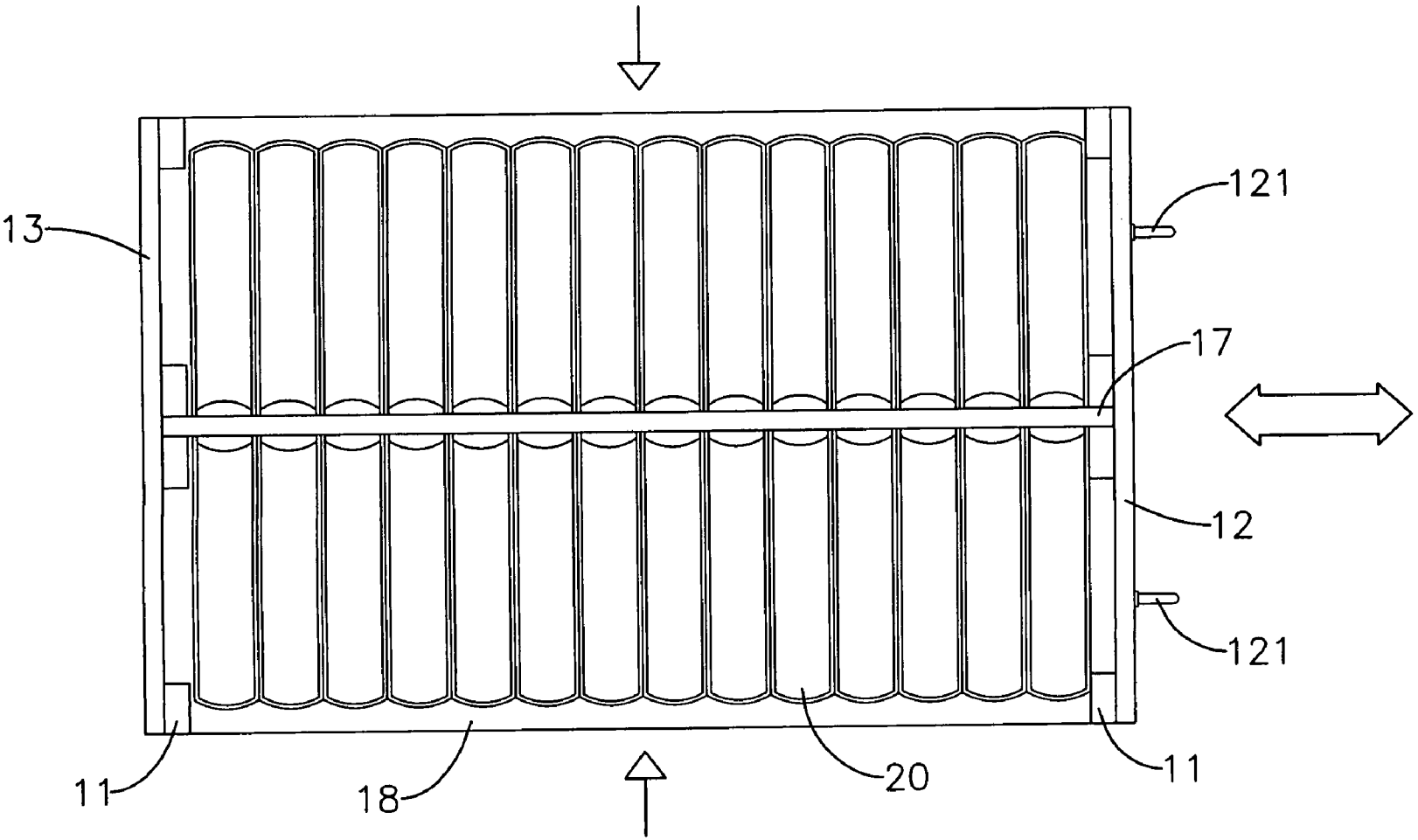
FIG. 10 is an operational top view of the third embodiment of the cabinet of the cabinet assembly in FIG. 9.

With reference to FIGS. 9 and 10, a third embodiment of the cabinet of the present invention may be a bookshelf. The inner chamber comprises a central partition (17) to separate the inner chamber to a right inner chamber and a left inner chamber. The right inner chamber communicates with the right opening and has multiple layers of shelves (18). The layers of the shelves (18) connect to the erect bar (11), are parallel with the bottom board (15) and allow the users to put books (20) on or take books (20) from the layers of the shelves (18) from the right opening. The left inner chamber communicates with the left opening and has multiple layers of the shelves (18). The layers of the shelves (18) connect to the erect bar (11), are parallel with the bottom board (15) and allow the users to put books (20) on or take books (20) from the layers of the shelves (18) from the left opening.

Figure 11:
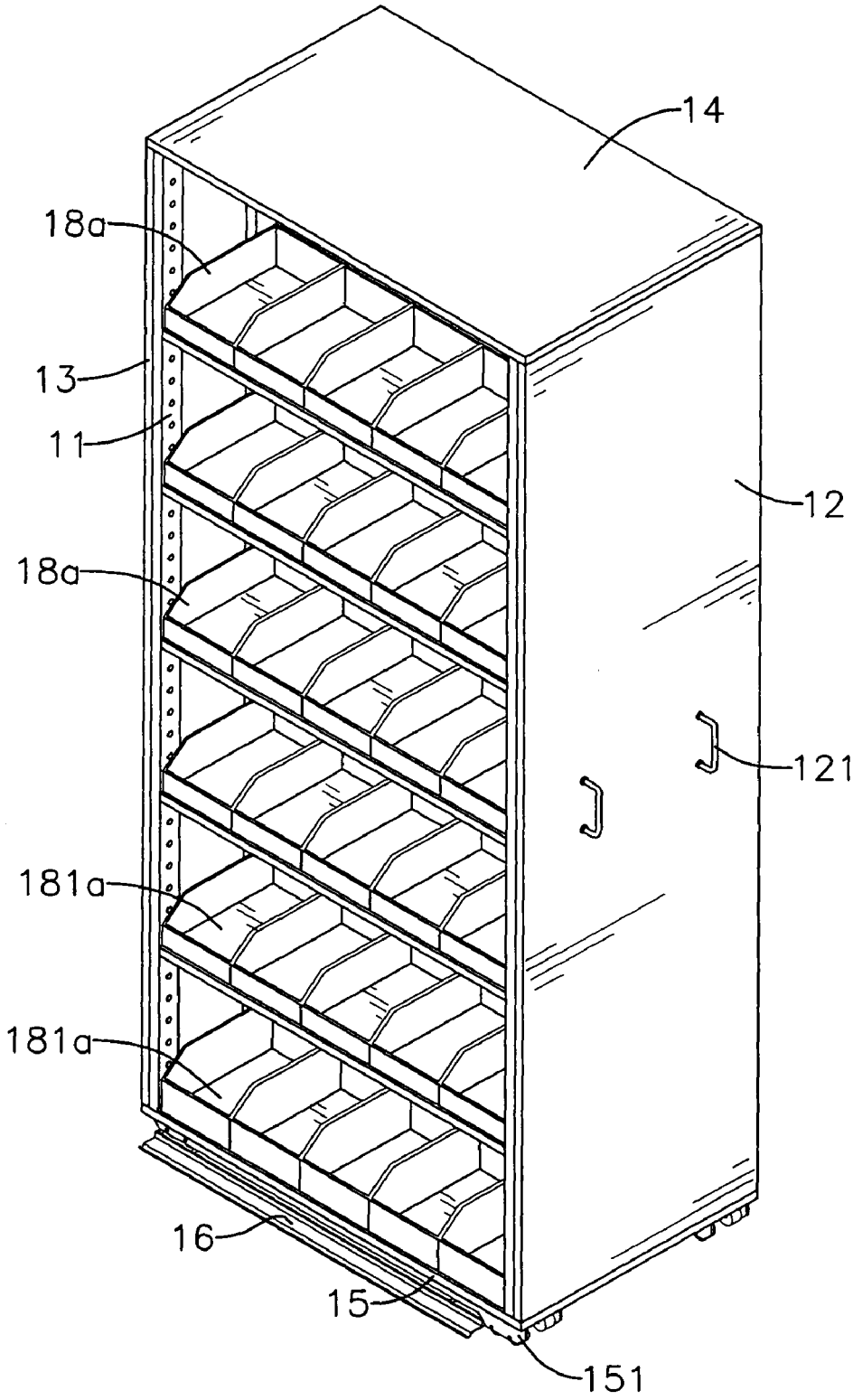
FIG. 11 is a perspective view of a fourth embodiment of a cabinet of a cabinet assembly in accordance with the present invention.

FIG. 11 shows a fourth embodiment of the cabinet of the present invention. The inner chamber comprises a central partition (17) as shown in FIG. 2 to separate the inner chamber to a right inner chamber and a left inner chamber. The right inner chamber communicates with the right opening and has multiple layers of classified shelves (18*a*). The layers of the classified shelves (18*a*) connect to the erect bar (11) and are parallel with the bottom board (15). Each layer of the classified shelves (18*a*) has multiple containing sections (181*a*) that allow the users to classify their objects. The left inner chamber communicates with the left opening and has multiple layers of classified shelves (18*a*). The layers of the classified shelves (18*a*) connect to the erect bar (11) and are parallel with the bottom board (15). Each layer of the classified shelves (18*a*) has multiple containing sections (181*a*) that allow the users to classify their objects.

Figure 12:
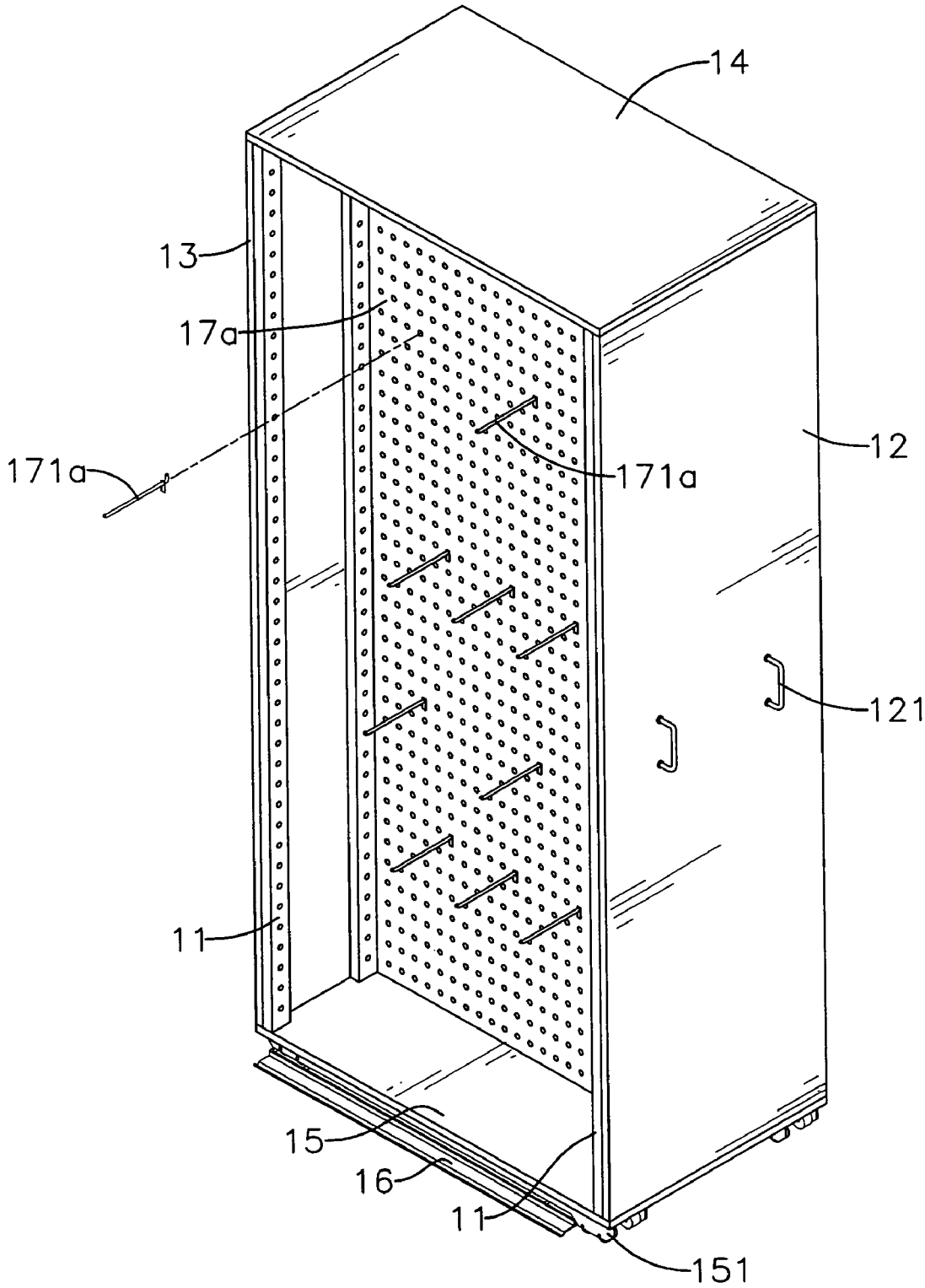
FIG. 12 is a perspective view of a fifth embodiment of a cabinet of a cabinet assembly in accordance with the present invention.

FIG. 12 shows a fifth embodiment of the cabinet of the present invention. The inner chamber comprises a central partition (17*a*) to separate the inner chamber to a right inner chamber and a left inner chamber. The central partition (17*a*) has a left surface, a right surface and multiple hooks (171*a*). The hooks (171*a*) are mounted on the left surface and the right surface of the partition (17*a*) and allow the users to hang the object on the hooks. The right inner chamber communicates with the right opening. The left inner chamber communicates with the left opening.

Figure 13:
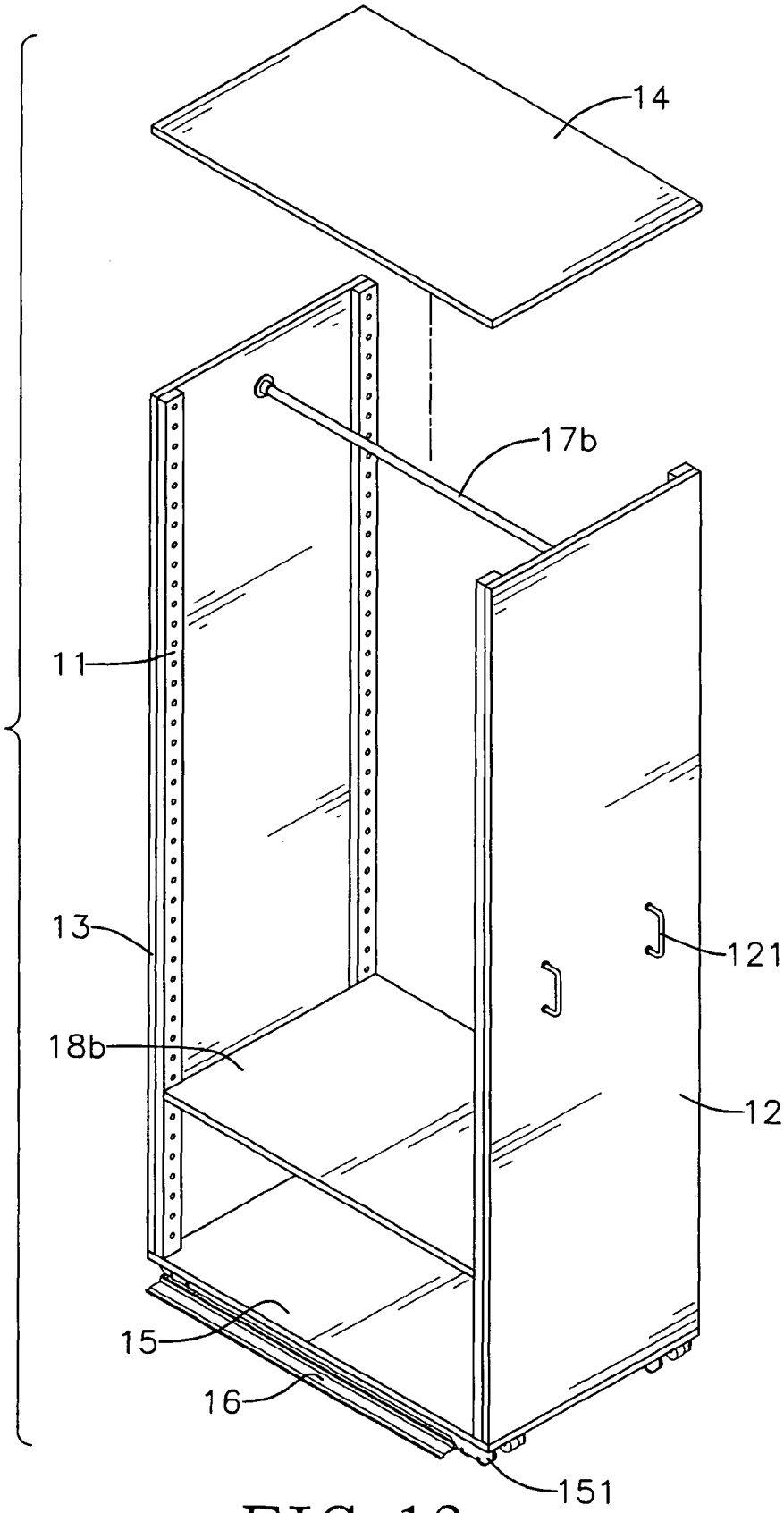
FIG. 13 is an exploded perspective view of a sixth embodiment of a cabinet of a cabinet assembly in accordance with the present invention.
Figure 14:
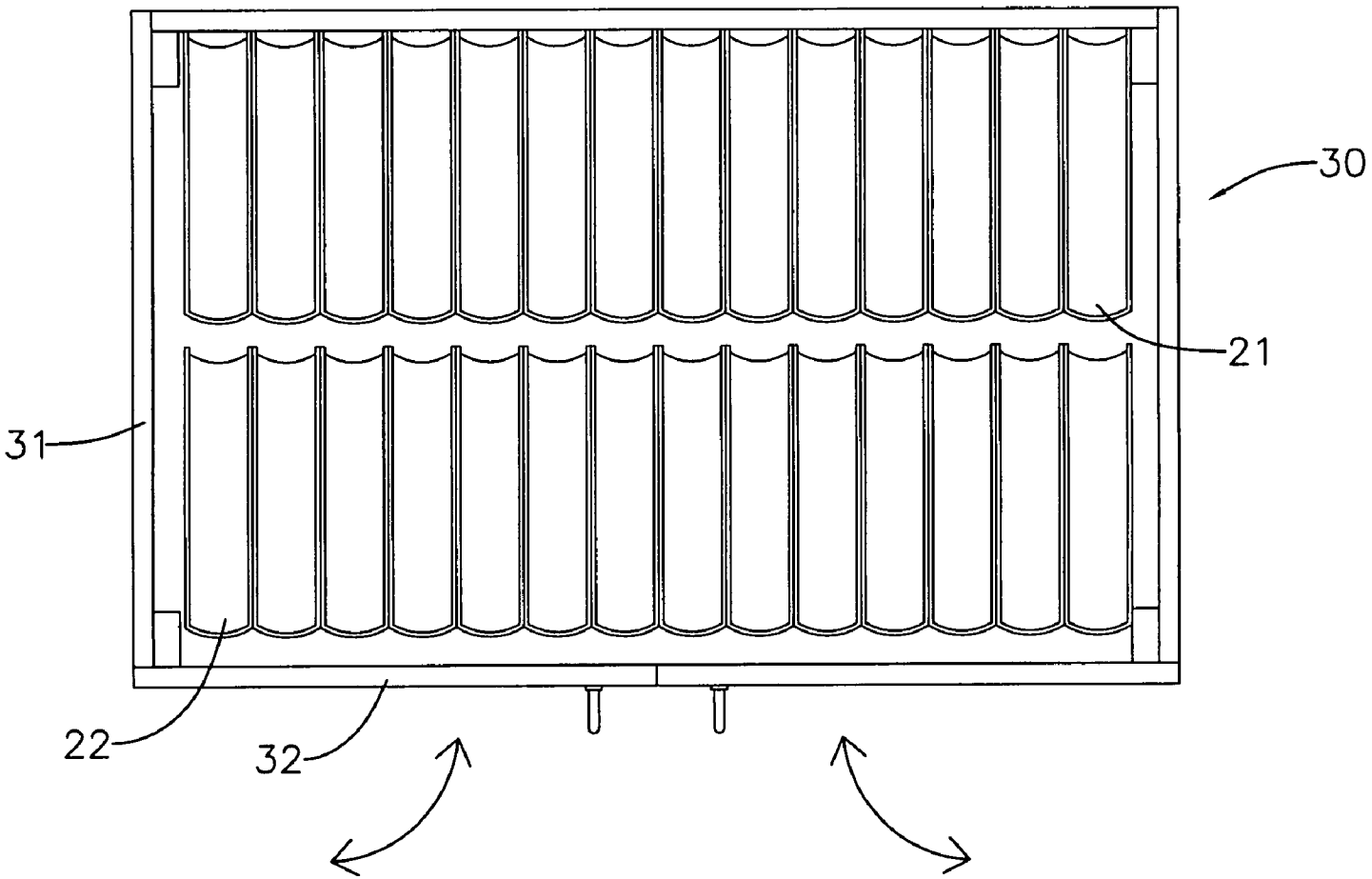
FIG. 14 PRIOR ART
FIG. 14 is a top view of a conventional cabinet in accordance with the prior art.

FIG. 13 shows a sixth embodiment of the cabinet of the present invention. The inner chamber of the cabinet has a shaft (17*b*) and at least one layer of shelf (18*b*). The shaft (17*b*) is mounted in the inner chamber near the top board (14), connects to the front board (12) and the rear board (13) and allows the user to hang clothes or the like on the shaft (17*b*). The layer of the shelf (18*b*) connect to the erect bar (11), is parallel with the bottom board (15) and allow the users to put the objects on or take the objects from the layer of the shelf (18*b*) from both the right opening and the left opening.

When the cabinet is pull, the users can put the objects from both the left opening and the right opening, so the cabinet can contain two rows of objects that do not be shielded by each other. Therefore, the users can find the objects what they want easily. The inner chamber can be completely utilized. When the cabinet is pushed to an original position, all the cabinets are arranged orderly and only the front boards of the cabinets can be seen. Therefore, a living room, a study or other room with the cabinet assembly of the present invention is able to provide a neat and a clean environment. Furthermore, the users can decide how much cabinet to be assembled according to their demand and a size of a room, and the cabinet assembly can be reused when the cabinet assembly is moved to another room. Accordingly, the cabinet assembly of the present invention saves users' money and resources.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A cabinet assembly comprising at least one cabinet and each one of the at least one cabinet being a frame and having multiple erect bars;

a front board;

a rear board;

a bottom board having a lower surface;

a left opening;

a right opening;

a wheel assembly being mounted on the lower surface of the bottom board and having multiple wheels being mounted on the lower surface of the bottom board; and a substrate being mounted below the bottom board and contacting the wheels, allowing the wheels to slide on the substrate and holding the cabinet; and an inner chamber being formed between the front board, the rear board and the bottom board and communicating with the left opening and the right opening; wherein the wheel assembly of each one of the at least one cabinet has two lines of wheels being mounted longitudinally on the lower surface of the bottom board of the cabinet in parallel and respectively near the left opening and the right opening of the cabinet;

each line of the wheels has a first group of wheels being mounted longitudinally on the lower surface of the bottom board near the front board of a corresponding one of the at least one cabinet; and a second group of wheels being mounted longitudinally on the lower surface of the bottom board near the rear board of the corresponding cabinet;

the substrate of each one of the at least one cabinet has an upper surface, a lower surface, a front, a rear, two sides and two channels being formed in the upper surface of the substrate, corresponding to the second groups of wheels of the cabinet and allowing the second groups of wheels to slide along the channels;

the first group of the wheels is located outside the channels of the substrate and is substantially flush with the lower surface of the substrate, and the substrate of each one of the at least one cabinet further has a first connector being a longitudinal bar and being formed in one of the sides of the substrate; and a second connector being a longitudinal slot corresponding to the longitudinal bar, being formed in the other side of the substrate; whereby the second connector of one substrate connects the first connector of an adjacent substrate.

2. The cabinet assembly as claimed in claim 1, wherein each one of the at least one cabinet further has a top board; and the front board of each one of the at least one cabinet further has at least one handle being mounted on the front board.

3. The cabinet assembly as claimed in claim 1, wherein each channel has two limiting protrusions respectively protruding in the channel from the front and the rear of the substrate of a corresponding one of the at least one cabinet and limiting the second groups of wheels on the corresponding cabinet to slide only in the channel.

* * * * *